US005329856A

United States Patent [19]

Lorscheider

[11] Patent Number: 5,329,856

[45] Date of Patent: Jul. 19, 1994

[54] CONTINOUS ACTION TAMPING MACHINE

[75] Inventor: Frederic Lorscheider, Longeville-Les-Saint-Avold, France

[73] Assignee: Franz Plasser Bahnbaumaschinenindustriegesellschaft mbH, Vienna, Austria

[21] Appl. No.: 94,551

[22] Filed: Jul. 20, 1993

[30] Foreign Application Priority Data

Aug. 21, 1992 [AT] Austria ..... 1688/92

[51] Int. Cl.[5] ..... E01B 27/00

[52] U.S. Cl. ..... 104/2; 104/7.2; 104/12; 213/75 R

[58] Field of Search ..... 104/2, 7.2, 12; 105/3; 213/75

[56] References Cited

U.S. PATENT DOCUMENTS

| | | | |
|---|---|---|---|
| 857,572 | 6/1907 | Amey | 104/2 |
| 1,318,318 | 10/1919 | Fereday | 105/3 |
| 4,630,541 | 12/1986 | Theurer et al. | 104/7.2 |
| 4,643,101 | 2/1987 | Theurer | 104/7.2 |
| 5,101,733 | 8/1992 | Mohr | 104/12 |
| 5,172,635 | 12/1992 | Theurer | 104/7.2 X |
| 5,231,929 | 8/1993 | Theurer et al. | 104/2 |
| 5,237,143 | 8/1993 | Scheuchzer | 104/2 X |

OTHER PUBLICATIONS

"Eisenbahningenieur" 42, Jan. 91, pp. 24/25 (FIG. 5).

*Primary Examiner*—Robert J. Oberleitner
*Assistant Examiner*—S. Joseph Morano
*Attorney, Agent, or Firm*—Collard & Roe

[57] ABSTRACT

A mobile machine for leveling, lining and tamping a track, has an elongated machine frame supported on undercarriages for continuous movement along the track in an operating direction during a leveling, lining and tamping operation. The machine frame comprises three machine frame parts arranged successively adjacent each other in a direction of elongation of the machine frame and pivotally linked to each other, one of the machine frame parts being an auxiliary trussing linking the two adjacent machine frame parts to each other during the operation. A carrier frame is supported on at least one undercarriage for intermittent movement along the track relative to the continuously moving machine frame, the one machine frame part bridging over the carrier frame, and a track tamping unit and a track lifting and lining unit are mounted on the carrier frame.

11 Claims, 3 Drawing Sheets

CONTINOUS ACTION TAMPING MACHINE

BACKGROUND OF THE INVENTION

1. Field of the Invention

The present invention relates to a mobile machine for leveling, lining and tamping a track, which comprises an elongated machine frame supported on undercarriages for continuous movement along the track in an operating direction during a leveling, lining and tamping operation, the machine frame comprising three machine frame parts arranged successively adjacent each other in a direction of elongation of the machine frame and pivotally linked to each other, a carrier frame supported on at least one undercarriage for intermittent movement along the track relative to the continuously moving machine frame and one machine frame part bridging over the carrier frame, and a track tamping unit and a track lifting and lining unit mounted on the carrier frame.

2. Description of the Prior Art

A machine of this type has been described in an article in "Der Eisenbahningenieur", January 1991, pages 24/25 (FIG. 5), where it has been designated as machine AC-109 FRP. In this machine, the intermediate machine frame part arranged between the front and rear machine frame parts is supported at its opposite ends by swivel trucks and these front and rear machine frame parts are trailers, one of whose ends is linked to the ends of the intermediate machine frame part while their opposite ends are supported on undercarriages- The front trailer is equipped with a ballast plow arrangement and operating controls while the rear trailer carries a ballast broom arrangement. A carrier frame is arranged below the bridge-like intermediate machine frame part between the swivel trucks, and its rear end is supported on the track by an undercarriage. A vertically adjustable tamping unit arranged for the simultaneous tamping of two ties and a track lifting and lining unit are mounted on the carrier frame. A front end of the carrier frame is linked to the intermediate machine frame part and connected thereto by a displacement drive for displacing the carrier frame in the direction of elongation of the machine frame. This enables the so-called tamping satellite to be intermittently displaced during the tamping operation while the machine frame advances continuously along the track. This machine can be used only in tangent track but not in switches.

Another type of a continuous action tamping machine has been disclosed in U.S. Pat. No. 4,630,541. This machine has an elongated, bridge-like machine frame whose opposite ends are supported on the track by swivel trucks. A carrier frame is linked to the elongated machine frame between the swivel trucks as a satellite carriage and is supported on the track by two undercarriages. A coupling constituted by a hydraulic longitudinal displacement drive connects the satellite carriage to the machine frame. The carrier frame carries only the tamping unit and track lifting and lining unit while the operator's cabs, the power plant and controls are arranged on the continuously advancing machine frame to reduce the weight of the intermittently moving satellite carriage.

U.S. Pat. No. 5,101,733 discloses a ballast tamping machine comprising a two-part machine frame whose two parts are pivotally linked to each other and which is supported on the track by three undercarriages- A tamping unit and a track lifting and lining unit precede the intermediate undercarriage in the operating direction and are arranged within view of an operator's cab. A ballast plow arrangement and a broom arrangement are mounted on the machine frame rearwardly of the intermediate undercarriage. A ballast conveyor arrangement extending in the direction of elongation of the machine frame has an inlet end receiving excess ballast swept up by the broom arrangement and a discharge end discharging the excess ballast into a storage bin. The storage bin is connected to a ballast discharge device with discharge openings adjacent the tamping unit to deliver ballast into cribs in track sections which do not have enough ballast for effective tamping. The discharge openings are remote-controlled from the operator's cab.

SUMMARY OF THE INVENTION

It is the primary object of this invention to provide a continuous action tamper of the first-described type which retains all the advantages of such a tamper while considerably simplifying its structure.

The above and other objects are accomplished in this machine according to the invention by making one of the machine frame parts merely an auxiliary trussing linking the two adjacent machine frame parts to each other during the operation, the one machine frame part bridging over the carrier frame.

This machine frame part construction has the advantage of making it possible to adapt the carrier frame for carrying switch tamping and track lifting units, on the one hand, and to assure, on the other hand, a dependable continuous advance at a readily controllable constant speed of the machine frame parts adjacent the intermittently moving carrier frame. This is achieved by the auxiliary trussing which serves to transmit the continuous forward thrust to the distant machine frame part. Independently of this continuous advance, the carrier frame can be moved intermittently from tamping stage to tamping stage. Since the one machine frame part bridging over the carrier frame serves only as a forward thrust transmitting trussing, its cross section may be severely reduced and the height of the carrier frame therebelow may be correspondingly increased so that, for example, transversely displaceable tamping units for operation in switches may be mounted thereon. Furthermore, such a planar auxiliary trussing will not interfere with the operation of the carrier frame and its width will not exceed the width of the track.

If a coupling links the one machine frame part to an adjacent one of the machine frame parts, the coupling being adjustable in the direction of elongation of the machine frame, the coupling may be adjusted when the machine is moved between operating sites and the machine frame parts may be incorporated in a train while coupled together in the lower part of the machine frame parts.

According to another preferred embodiment, the machine comprises a displacement drive connecting one end of the carrier frame to an adjacent one of the machine frame parts for displacing the carrier frame in the direction of elongation of the machine frame. In this way, the carrier frame supported on the adjacent continuously advancing machine frame part may be readily displaced intermittently from tamping stage to tamping stage.

The auxiliary trussing is preferably a lattice framework arranged above the carrier frame and comprised of two parallel carrier rods extending in the direction of elongation of the machine frame and truss rods connecting the carrier rods. Such a lattice framework may advantageously have a relative small cross section while being sufficiently vertically spaced from the track to permit a relatively high carrier frame to be lodged thereunder to accommodate operating tools for switch work.

An incorporation of the machine into a train will be facilitated, even if the carrier frame is massive, if an operator's cab is mounted on the carrier frame, a respective one of the undercarriages supports each end of the carrier frame on the track, and a respective coupling links each carrier frame end to an adjacent one of the machine frame parts. Each adjacent machine frame part is preferably a trailer one of whose ends is linked to the carrier frame by this coupling and an opposite one of the trailer ends is supported on the track by an undercarriage, each coupling being adjustable in the direction of elongation of the machine frame and comprising a blocking device for locking the coupling in an adjusted position.

In another preferred embodiment, a front machine frame part in the operating direction is supported on the track by two undercarriages at respective ends of the front machine frame part, a coupling links a front end of the carrier frame in the operating direction to the front machine frame part, the coupling being adjustable in the direction of elongation of the machine frame, and a displacement drive connects the front machine frame part and the carrier frame for displacing the carrier frame in the direction of elongation. Such a carrier frame, with a single undercarriage, has a very simple structure.

The rear machine frame part in the operating direction may advantageously have a recessed portion and a broom arrangement may be vertically adjustably mounted on the rear machine frame part, the broom arrangement comprising a rotatable brush and a conveyor band. Furthermore, a ballast storage bin may be mounted on one of the adjacent machine frame parts, the ballast storage bin having a ballast discharge opening, and the machine may comprise a ballast conveyor arrangement having an inlet end arranged to receive the ballast from the discharge opening and a discharge end, and a ballast discharge device arranged to receive the ballast from the discharge end and to discharge the ballast adjacent the track tamping unit. Each adjacent machine frame part is linked to the carrier frame by a coupling, each coupling being adjustable in the direction of elongation of the machine frame for displacing the machine frame parts and the carrier frame relative to each other in said direction along a displacement path, and the ballast discharge device has an upper V-shaped inlet opening for receiving the ballast from the discharge end, the inlet opening having a width corresponding at least to the displacement path.in the direction of elongation of the machine frame. With such a structure, excess ballast will be swept up from the track without interfering with the tamping operation and this excess ballast can be stored for selective use at points where there is insufficient ballast for providing proper tamping of the ties.

Finally, if one undercarriage supports a rear end of the carrier frame in the operating direction and an operator's cab is arranged at the rear end, the operator will move with the continuously advancing machine frame parts adjacent the carrier frame without being subjected to the tiring impacts of the intermittent movements between tamping stages.

BRIEF DESCRIPTION OF THE DRAWING

The above and other objects, advantages and features of the present invention will become more apparent from the following detailed description of certain now preferred embodiments thereof, taken in conjunction with the accompanying somewhat schematic drawing wherein.

DETAILED DESCRIPTION OF THE PREFERRED EMBODIMENT

Figure 1:
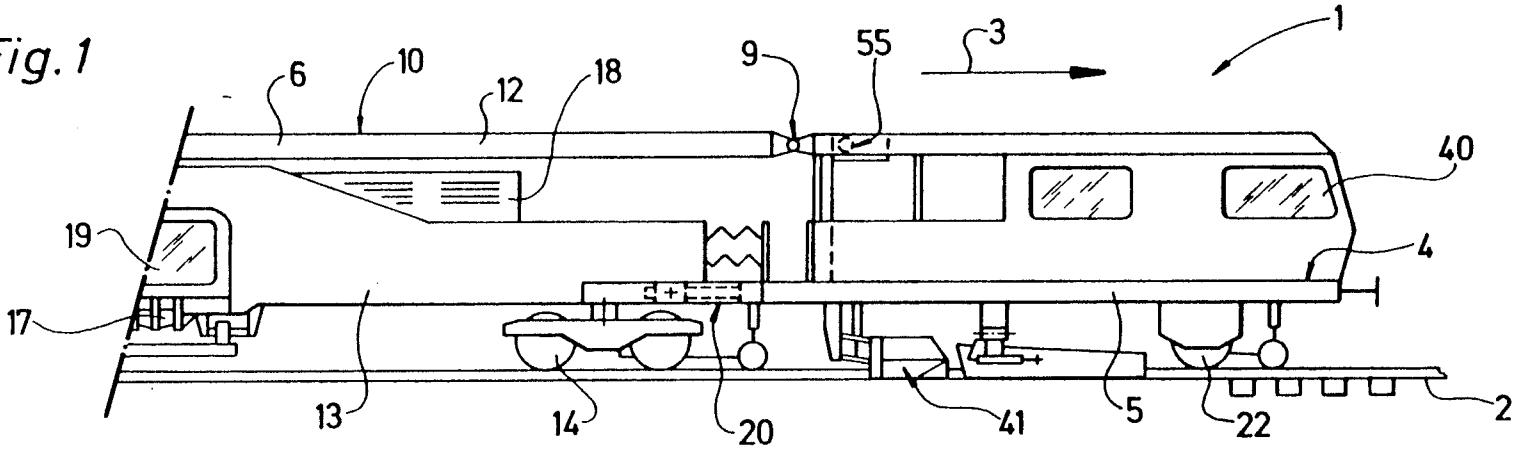
FIGS. 1 and 2 are side elevational views of a machine according to one embodiment of the invention, FIG. 1 showing the front portion and FIG. 2 the rear portion of the elongated machine frame comprised of three successively adjacent machine frame parts.
Figure 2:
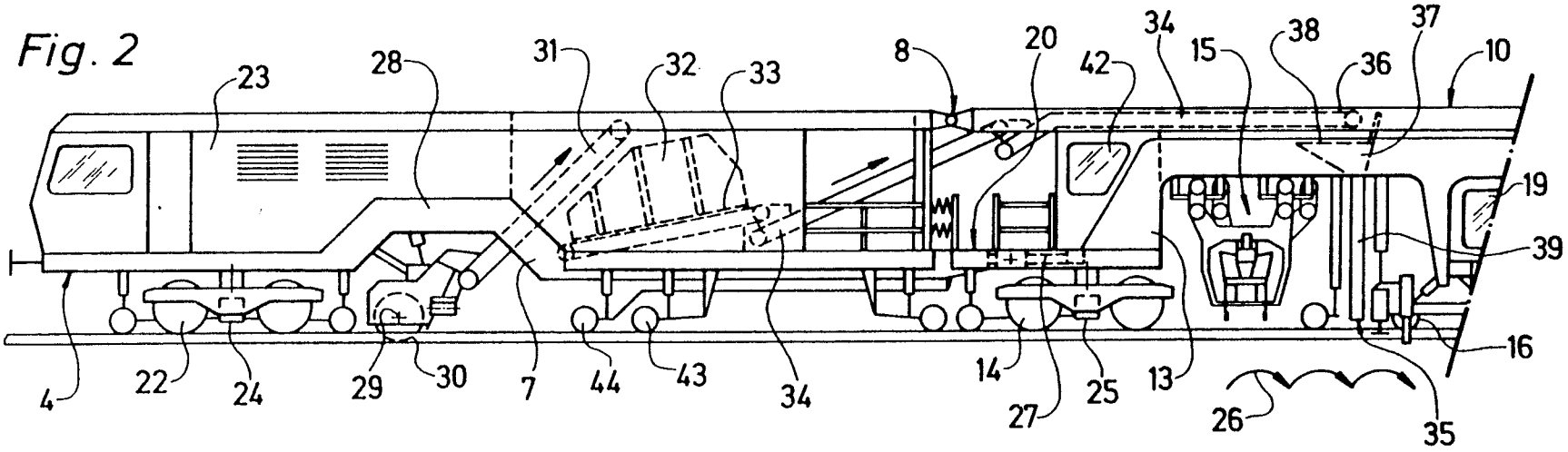
Figure 3:
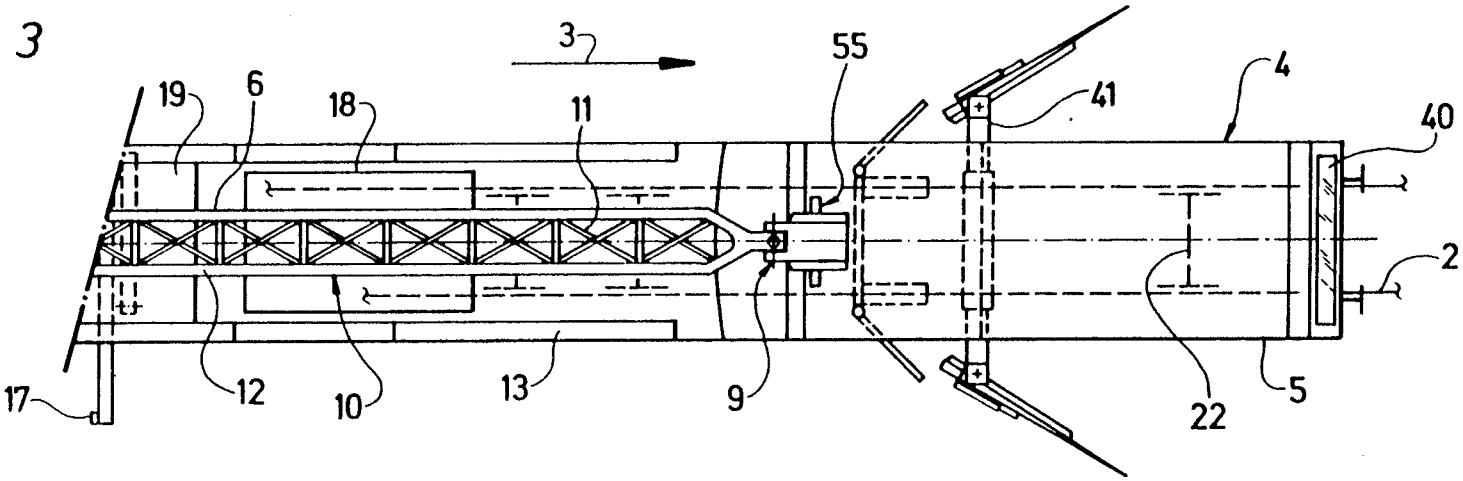
FIGS. 3 and 4 are top views of the machine of FIGS. 1 and 2.
Figure 4:
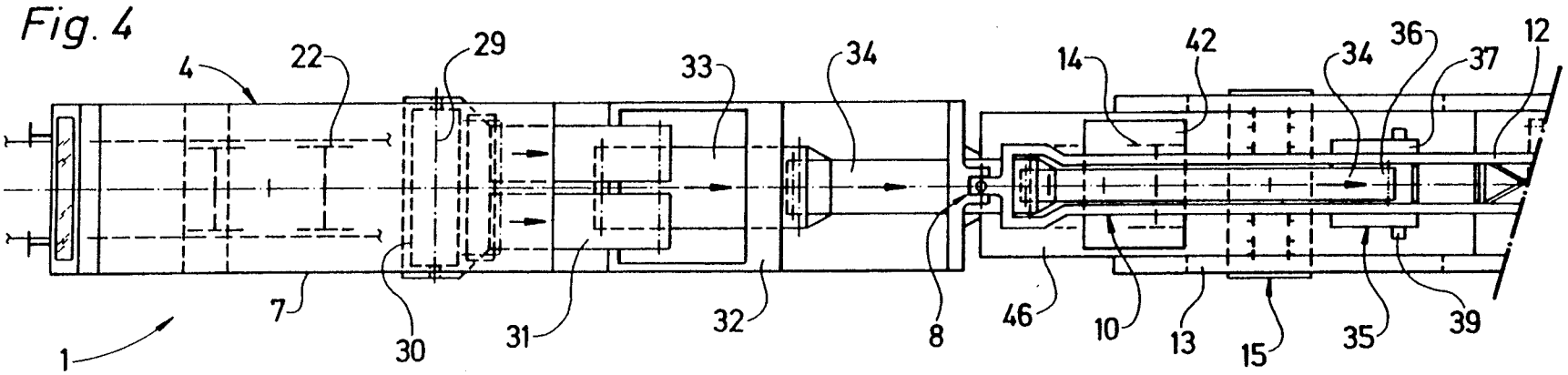

Referring now to the drawing and first to FIGS. 1 to 4, there is shown mobile machine 1 for leveling, lining and tamping track 2. Tamping machine 1 comprises elongated machine frame 4 supported on undercarriages 22 for continuous movement along the track in an operating direction indicated by arrow 3 during a leveling, lining and tamping operation. Machine frame 4 comprises three machine frame parts 5, 6, 7 arranged successively adjacent each other in a direction of elongation of the machine frame and pivotally linked to each other. One, i.e. the intermediate, machine frame part 6 is an auxiliary trussing 10 linking the two adjacent machine frame parts 5 and 6 to each other during the operation at coupling points 8, 9 for universal movement relative to each other. This planar auxiliary trussing has a relatively small cross section and little height, extending exclusively along the upper portion of the machine frame. As shown in FIG. 3, auxiliary trussing 10 is a lattice framework arranged above a carrier frame 13 and comprised of two parallel carrier rods 12 extending in the direction of elongation of the machine frame 4 and truss rods 11 connecting the carrier rods. As will be described hereinafter in more detail in connection with FIG. 6, coupling 9 between intermediate machine frame part 6 and preceding machine frame part 5 adjacent thereto is so structured that the two machine frame parts may be displaced relative to each other in the direction of elongation of machine frame 4.

Carrier frame 13 is supported on at least one undercarriage for intermittent movement along track 2 relative to continuously moving machine frame 4, machine frame part 6 bridging over the carrier frame, and track tamping unit 15 and track lifting and lining unit 16 are mounted on carrier frame 13. Vertically adjustable tamping unit 15 is transversely displaceably mounted on carrier frame 13 for use in track switches and vertically and transversely adjustable drives link track lifting and lining unit 16 to the carrier frame. Furthermore, auxiliary lifting device 17 on carrier frame 13 serves to lift a branch track at a switch synchronously with the tamping and lifting of main track 2. Furthermore, power plant 18 and operator's cab 19 are mounted on carrier frame 13, cab 19 being arranged within view of units 15 and 16 and auxiliary lifting device 17 to enable an operator in the cab to monitor the operation. In the illustrated embodiment (see FIG. 5), a respective swivel truck 14 supports each end of carrier frame 13 on track 2, and a respective coupling 20 links each carrier frame end to an adjacent machine frame part 5, 7 for universal movement relative to each other, the coupling being adjustable in the direction of elongation of the machine frame. The coupling comprises blocking device 21 for locking coupling 20 in an adjusted position.

Figure 5:
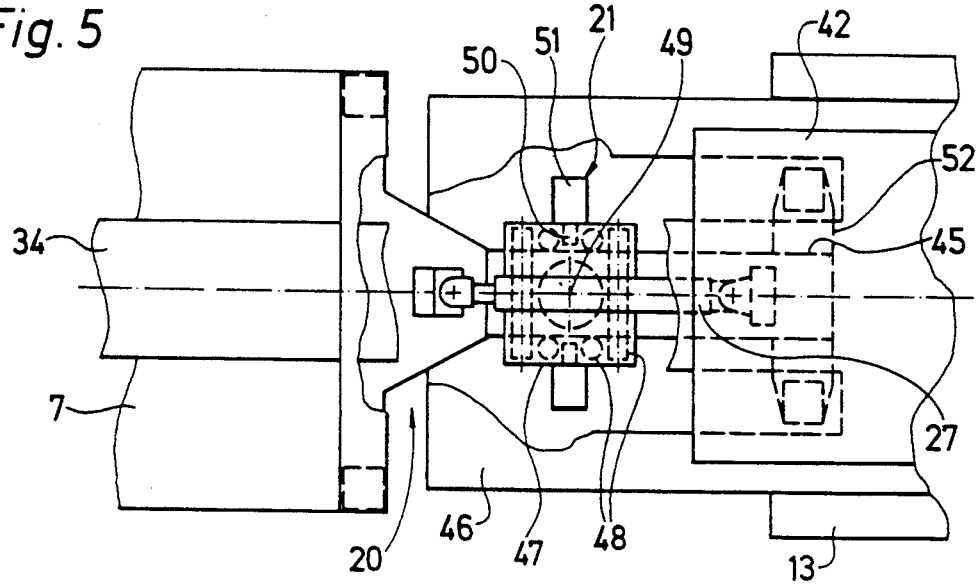
FIGS. 5 and 6 are enlarged fragmentary top views showing, respectively, a coupling at the rear end of the carrier frame and a coupling at the front end of the auxiliary trussing.
Figure 6:
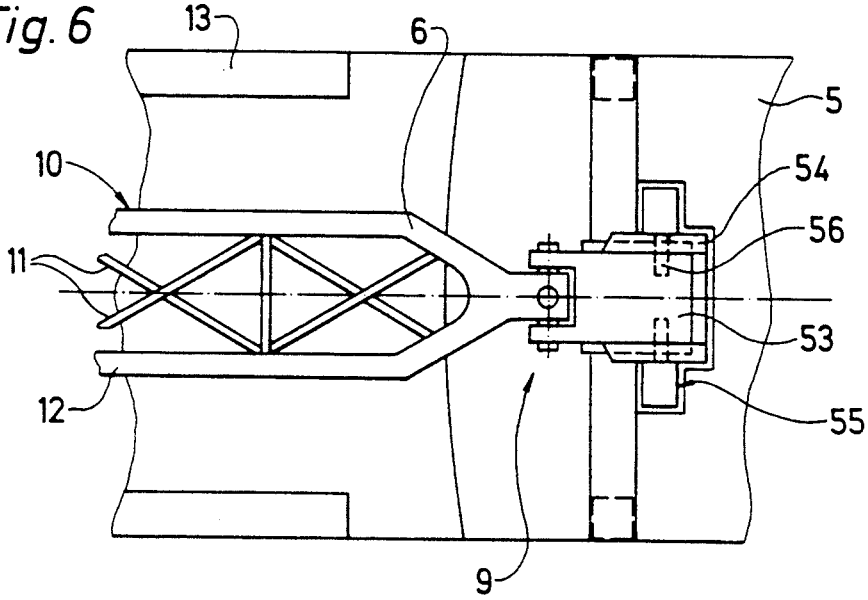

Each adjacent machine frame part 5, 7 is a trailer, one of whose ends is linked to carrier frame 13 by coupling 20 and an opposite one of the trailer ends is supported on the track by undercarriage 22. Undercarriage 22 supporting rear machine frame part 7 in the operating direction is equipped with drive 24 powered by energy source 23 on the rear machine frame part. This provides a continuous forward thrust to machine frame 4 in the operating direction during the tamping operation while independent drive 25 intermittently moves carrier frame 13 relative to the machine frame to enable the successive ties of track 2 to be tamped step by step, as indicated by small arrows 26. Auxiliary trussing 10, which bridges over the carrier frame, interconnects front and rear machine frame parts 5, 7 and holds them at a fixed distance to transmit the forward thrust from the rear machine frame part to the front machine frame part. Displacement drive 27 connects the rear end of carrier frame 13 to adjacent machine frame part 7 for displacing the carrier frame in the direction of elongation of the machine frame so as to support the intermittent movement of the carrier frame relative to the machine frame. As best seen in FIGS. 5 and 6, couplings 20 are independently displaceable in this direction on carrier frame 13, as will be explained in more detail hereinafter.

Rear machine frame part 7 succeeding carrier frame 13 in the operating direction has recessed portion 28 preceding swivel truck 22, and a broom arrangement is vertically adjustably mounted on the rear machine frame part, the broom arrangement comprising a brush 30 rotatable about transversely extending axle 29 and adjacent conveyor band 31 for conveying excess ballast swept up from track 2 by rotatable brush 30 to ballast storage bin 32 mounted on machine frame part 7. The ballast storage bin has ballast discharge opening 33 at the bottom thereof. Ballast conveyor arrangement 34 has an inlet end arranged to receive the ballast from discharge opening 33 and a discharge end 36 forwardly thereof, and ballast discharge device 35 is arranged on carrier frame 13 to receive the ballast from the discharge end of ballast conveyor arrangement 34 and to discharge the ballast adjacent track tamping unit 15. The ballast discharge device is a funnel 37 disposed directly below ballast discharge end 36 and the funnel has an upper V-shaped inlet opening 38 for receiving the ballast from the discharge end. Inlet opening 38 has a maximum width corresponding at least to the displacement path of the carrier frame relative to the machine frame part in the direction of elongation of the machine frame provided by coupling 20 to assure a proper discharge of ballast from conveyor arrangement 34 mounted on machine frame 4 into funnel 37 mounted on carrier frame 13 when the carrier frame moves intermittently relative to the continuously advancing machine frame.

Front machine frame part 5 carries a large operator's cab 40 and a center and shoulder ballast plow arrangement 41. Operator's cab 42 is arranged at the rear end of carrier frame 13 above rear undercarriage 14 supporting the rear end. Track position monitoring devices 43, 44 are mounted on carrier frame 13 and machine frame 4 for controlling the track position during track leveling, lining and tamping.

Rear coupling 20 which longitudinally displaceably interconnects carrier frame 13 and rear machine frame part 7 is shown in detail in FIG. 5. As shown, the front end of machine frame part 7 is formed by center beam 45 which projects in the direction of elongation of machine frame 4 underneath platform 46 of carrier frame 13, which forms a footpath. Projecting center beam 45 is glidably supported and guided in bearing block 47. For this purpose, the bearing block is equipped with guide rollers 48 some of which are rotatable about horizontal axes extending transversely to the track and some of which are rotatable about vertical axes, the guide rollers being so arranged that the center beam is supported with some play to permit machine frame 7 and carrier frame 13 to move slightly with respect to each other sideways and up and down in track curves and in track sections which are not entirely smooth. For this reason, bearing block 47 is mounted on carrier frame 13 for rotation about vertical axis 49. Front coupling 20 has substantially the same structure, a center beam projecting from front machine frame part 5 being supported and guided in a bearing block at the front end of carrier frame 13. Longitudinal displacement drive 27 is linked to carrier frame 13 and the adjacent machine frame part and serves to support the intermittent movement of carrier frame 13 by drive 25.

To connect the machine frame parts fixedly with carrier frame 13 during transit of the machine so as to assure the transmission of the thrust forces, blocking device 21 is mounted on bearing block 47. The blocking device comprises two pins 50 which may be engaged in recesses in center beam 45 by remote-controllable drives 51. The front end of projecting center beam 45 carries a support 52 for mounting operator's cab 42 on machine frame part 7.

FIG. 6 illustrates the connection of the front end of auxiliary trussing 10 bridging over carrier frame 13 to front machine frame part 5 at coupling point 9. On the one hand, this connection must be fixed to enable machine frame parts 5, 6, 7 to be coupled together during operation to provide a continuously advancing unit. On the other hand, the connection must be freely movable in the direction of the elongation of machine frame 4 during transit of the machine between operating sites since blocking device 21 fixedly couples the carrier frame to machine frame parts 5 and 7 during transit. For this purpose, a gliding block 53 is universally linked to a narrow end of auxiliary trussing 10 and the gliding block is arranged in gliding bearing 54 for displacement in this direction. Gliding bearing 54 is mounted on the upper portion of machine frame part 5 coplanar with the auxiliary trussing and is equipped with blocking device 55 comprising, similarly to blocking device 21, two remote-controllable pins 56 engageable with gliding block 53.

Figure 7:
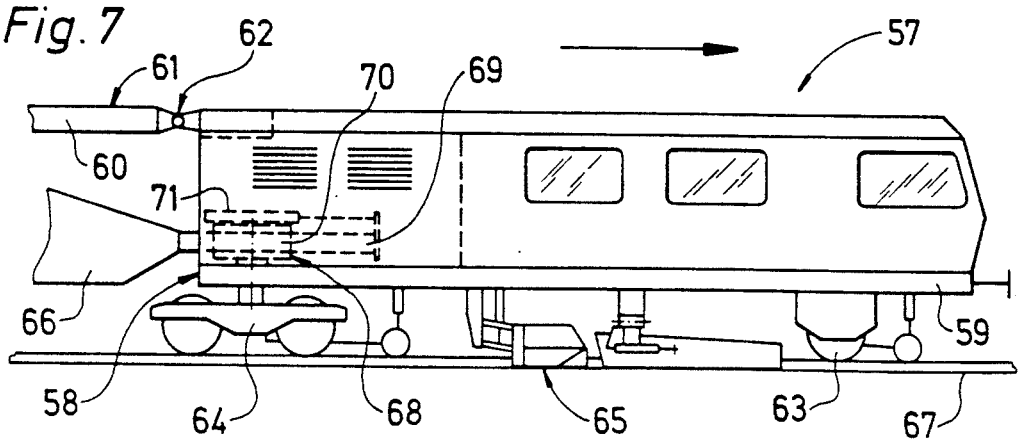
FIG. 7 is a partial side elevation showing the front portion of another embodiment of the machine.

The mobile track leveling, lining and tamping machine 57 shown in FIG. 7 has an elongated machine frame 58 comprising a number of machine frame parts, only front machine frame part 59 in the operating direction being fully shown while only the front ends of adjacent auxiliary trussing 61 constituting intermediate machine frame part 60 and carrier frame 66 are visible in this figure. The arrangements of the additional machine frame parts and the carrier frame are the same as in the above-described embodiment. Front machine frame part 59 is supported on track 67 by two undercarriages 63, 64 at respective ends of front machine frame part 59. Coupling 68 links a front end of carrier frame 66 in the operating direction to the front machine frame part, the coupling being adjustable in the direction of elongation of the machine frame, and displacement drive 71 connects the front machine frame part and the carrier frame for displacing the carrier frame in the direction of elongation.

Blockable coupling 62 similar to the coupling described in connection with FIG. 6 longitudinally displaceably connects auxiliary trussing 61 to front machine frame part 59. The front end of carrier frame 66 is supported in coupling 68 on front machine frame part 59 so that the carrier frame may be displaced relative to the front machine frame part in the direction of elongation of machine frame 58. Center beam 69 projects from the front end of carrier frame 66 beyond the rear end of front machine frame part 59 and is supported thereon in gliding bearing 70 which is mounted rotatably about a vertical axis on the front machine frame part. Longitudinal displacement drive 71 connects gliding bearing 70 and the front machine frame part on which it is mounted to carrier frame 66 and serves to displace the carrier frame relative to machine frame 58 during tamping of track 67.

Mobile machine 1 may be used for tamping tangent track as well as switches. When tamping tangent track, blocking devices 21 of couplings 20, which fixedly connected carrier frame 13 to front and rear machine frame parts 5, 6 during transit, are unblocked when the machine reaches the operating site. At the same time, blocking device 55 is operated for fixedly connecting auxiliary trussing 10 to front machine frame part 5 at coupling point 9. Carrier frame 13 may now be moved intermittently for successively tamping the track ties as machine frame 4 continuously advances in the operating direction. During the operation, the operator is in cab 42 so that he may not be subjected to the stress of the repeated stops and starts of the carrier frame. However, during the tamping of a switch, a continuous advance of the machine frame is not advantageous since the adjustment of the operating tools requires more time to adapt them to the constantly changing track and tie spacing conditions. During switch work, the operator is placed in cab 19 which has a better view of the operating units, including auxiliary lifting device 17.

What is claimed is:

1. A mobile machine for leveling, lining and tamping a track, which comprises (a) an elongated machine frame supported on undercarriages for continuous movement along the track in an operating direction during a leveling, lining and tamping operation, the machine frame comprising;

(1) three machine frame parts arranged successively adjacent each other in a direction of elongation of the machine frame and pivotally linked to each other, (2) one of the machine frame parts being an auxiliary trussing linking the two adjacent machine frame parts to each other during the operation, (b) a carrier frame supported on and directly above at least one of the undercarriages for intermittent movement along the track relative to the continuously moving machine frame, the one machine frame part bridging over the carrier frame, (c) a respective coupling linking each carrier frame end to an adjacent one of the machine frame parts, and (d) a track tamping unit and a track lifting and lining unit mounted on the carrier frame.

2. The mobile track leveling, lining and tamping machine of claim 1, further comprising a displacement drive connecting one end of the carrier frame to an adjacent one of the machine frame parts for displacing the carrier frame in the direction of elongation of the machine frame.

3. The mobile track leveling, lining and tamping machine of claim 1, wherein the auxiliary trussing is a lattice framework arranged above the carrier frame and comprised of two parallel carrier rods extending in the direction of elongation of the machine frame and truss rods connecting the carrier rods.

4. The mobile track leveling, lining and tamping machine of claim 1, wherein an operator's cab is mounted on the carrier frame, and a respective one of the undercarriages supports each end of the carrier frame on the track.

5. The mobile track leveling, lining and tamping machine of claim 1, wherein a rear one of the machine frame parts in the operating direction has a recessed portion, further comprising a broom arrangement vertically adjustably mounted on the rear machine frame part, the broom arrangement comprising a rotatable brush and a conveyor band.

6. The mobile track leveling, lining and tamping machine of claim 1, further comprising a ballast storage bin mounted on one of the adjacent machine frame parts, the ballast storage bin having a ballast discharge opening, a ballast conveyor arrangement having an inlet end arranged to receive the ballast from the discharge opening and a discharge end, and ballast discharge device arranged to receive the ballast from the discharge end and to discharge the ballast adjacent the track tamping unit.

7. The mobile track leveling, lining and tamping machine of claim 1, wherein the one undercarriage supports a rear end of the carrier frame in the operating direction, further comprising an operator's cab mounted on the adjacent machine frame part at said rear end above the one undercarriage.

8. A mobile machine for leveling, lining and tamping a track, which comprises (a) an elongated machine frame supported on undercarriages for continuous movement along the track in an operating direction during a leveling, lining and tamping operation, the machine frame comprising (1) three machine frame parts arranged successively adjacent each other in a direction of elongation of the machine frame and pivotally linked to each other, (2) one of the machine frame parts being an auxiliary trussing linking the two adjacent machine frame parts to each other during the operation, (b) a coupling linking the one machine frame part to an adjacent one of the machine frame parts, the coupling being adjustable in the direction of elongation of the machine frame, (c) a carrier frame supported on at least one of the undercarriages for intermittent movement along the track relative to the continuously moving machine frame, the one machine frame part bridging over the carrier frame, and (d) a track tamping unit and a track lifting and lining unit mounted on the carrier frame.

9. A mobile machine for leveling, lining and tamping a track, which comprises (a) an elongated machine frame supported on undercarriages for continuous movement along the track in an operating direction during a leveling, lining and tamping operation, the machine frame comprising (1) three machine frame parts arranged successively adjacent each other in a direction of elongation of the machine frame and pivotally linked to each other, (2) one of the machine frame parts being an auxiliary trussing linking the two adjacent machine frame parts to each other during the operation, (b) a carrier frame supported at each end on a respective one of the undercarriages for intermittent movement along the track relative to the continuously moving machine frame, the one machine frame part bridging over the carrier frame, (c) a respective coupling linking each carrier frame end to an adjacent one of the machine frame parts, (1) each coupling being adjustable in the direction of elongation of the machine frame and comprising a blocking device for locking the coupling in an adjusted position, (2) each of the adjacent machine frame parts being a trailer one of whose ends is linked to a respective one of the carrier frame ends by a respective one of the couplings and an opposite one of the trailer ends is supported on the track by a respective one of the undercarriages, (d) an operator's cab mounted on the carrier frame, and (e) a track tamping unit and a track lifting and lining unit mounted on the carrier frame.

10. A mobile machine for leveling, lining and tamping a track, which comprises (a) an elongated machine frame supported on undercarriages for continuous movement along the track in an operating direction during a leveling, lining and tamping operation, the machine frame comprising (1) three machine frame parts arranged successively adjacent each other in a direction of elongation of the machine frame and pivotally linked to each other, (2) one of the machine frame parts being an auxiliary trussing linking the two adjacent machine frame parts to each other during the operation, and (3) a front one of the machine frame parts in the operating direction being supported on the track by two of said undercarriages at respective ends of the front machine part, (b) a carrier frame supported on at least one of the undercarriages for intermittent movement along the track relative to the continuously moving machine frame, the one machine frame part bridging over the carrier frame, (c) a coupling linking a front end of the carrier frame in the operating direction to the front machine frame part, (1) the coupling being adjustable in the direction of elongation of the machine frame, (d) a displacement drive connecting the front machine frame part and the carrier frame for displacing the carrier frame in the direction of elongation, and (e) a track tamping unit and a track lifting and lining unit mounted on the carrier frame.

11. A mobile machine for leveling, lining and tamping a track, which comprises (a) an elongated machine frame supported on undercarriages for continuous movement along the track in an operating direction during a leveling, lining and tamping operation, the machine frame comprising (1) three machine frame parts arranged successively adjacent each other in a direction of elongation of the machine frame and pivotally linked to each other, (2) one of the machine frame parts being an auxiliary trussing linking the two adjacent machine frame parts to each other during the operation, (b) a carrier frame supported on at least one of the undercarriages for intermittent movement along the track relative to the continuously moving machine frame, the one machine frame part bridging over the carrier frame, (c) a coupling linking each one of the adjacent machine frame parts to the carrier frame, (1) each coupling being adjustable in the direction of elongation of the machine frame for displacing the machine frame parts and the carrier frame relative to each other in said direction along a displacement path, (d) a track tamping unit and a track lifting and lining unit mounted on the carrier frame, (e) a ballast storage bin mounted on one of the adjacent machine frame parts, (1) the ballast storage bin having a ballast discharge opening, (f) a ballast conveyor arrangement having an inlet end arranged to receive the ballast from the ballast discharge opening and a discharge end, and (g) a ballast discharge device arranged to receive the ballast from the discharge end and to discharge the ballast adjacent the track tamping unit, (1) the ballast discharge device having an upper V-shaped inlet opening for receiving the ballast from the discharge end, the inlet opening having a width corresponding at least to the displacement path in the direction of elongation of the machine frame.

* * * * *